United States Patent [19]

Tamura et al.

[11] Patent Number: 4,820,890

[45] Date of Patent: Apr. 11, 1989

[54] THREE-FUNCTION PRESSURE SWITCH

[75] Inventors: Yuuichi Tamura, Yokohama; Hirayoshi Suzuki, Hadano, both of Japan

[73] Assignee: Fuji Koki Mfg. Co. Ltd., Tokyo, Japan

[21] Appl. No.: 130,430

[22] Filed: Dec. 9, 1987

[51] Int. Cl.[4] ..... H01C 35/34

[52] U.S. Cl. ..... 200/81.4; 200/83 J; 200/83 P

[58] Field of Search ..... 92/5 R, 98 R; 200/81 R, 200/81.4, 81.5, 82 R, 83 R, 83 J, 83 P; 307/118; 73/861.47, 717, 723, 744, 745; 340/626

[56] References Cited

U.S. PATENT DOCUMENTS

| | | | |
|---|---|---|---|
| 4,091,249 | 5/1978 | Huffman | 200/83 P |
| 4,400,601 | 8/1983 | Brucken | 200/81.4 |
| 4,591,677 | 5/1986 | Hirota et al. | 200/83 J |
| 4,593,166 | 6/1986 | Hirota et al. | 200/83 J |

FOREIGN PATENT DOCUMENTS

| | | |
|---|---|---|
| 57-197146 | 12/1982 | Japan . |
| 59-82936 | 6/1984 | Japan . |

*Primary Examiner*—Gerald P. Tolin
*Attorney, Agent, or Firm*—Joseph Scaffetta, Jr.

[57] ABSTRACT

A pressure switch for controlling the pressure of a refrigerant has a first switch normally open biased, which first switch is used for a condenser, and a second switch normally closed biased, which second switch is used for a compressor. The three-function pressure switch has a pressure chamber partitioned by a diaphragm. First to third movable elements urged toward the diaphragm are displaced in response to the pressure applied via the diaphragm. Displacement of the first and second movable elements is restricted by a stepped portion of the housing. An actuating projection provided on the third movable element presses upward a second leaf spring of the second switch at a lower limit pressure value so as to open the second switch. When the pressure reaches a normal maximum value, a first snap disc mounted on the first movable element actuates the first switch via a push rod. First snap disc and the push rod are restored at a minimum pressure value. In case the pressure abnormally rises above an upper limit value, a second snap disc mounted on the second movable element is altered in shape, so that a cylindrical member connected to the second disc presses downward the second leaf spring. Because the second leaf spring is pivoted about the actuating projection, a movable contact mounted on one end of the second leaf spring is set apart from a stationary contact, so that the second switch is opened again.

9 Claims, 5 Drawing Sheets

THREE-FUNCTION PRESSURE SWITCH

BACKGROUND OF THE INVENTION

1. Field of the Invention

The present invention relates to a pressure switch for use in a refrigerator, for turning off a compressor according to abnormally high or low pressure of refrigerant and controlling the fan motor of a condenser.

2. Description of the Related Art

A pressure switch of this type is disclosed in Japanese Utility Model Disclosure No. 59-82936. As is shown in FIG. 8, this switch can turn off a compressor when the pressure of refrigerant is abnormally high or low, and can control the fan motor of a condenser. This switch comprises a first piston 3 interposed between disc 1 and a second piston 2, a first electric switch 4 located above piston 3, and a second electric switch 5 positioned below piston 3. Long terminals 6 and 7 of switch 4 provided on piston 3, extend through openings 9 and 10 made in a lower unit 8, and can move upward of downward as piston 3 moves, the lower ends of terminals 6 and 7 project from lower unit 8.

In this pressure switch, the first piston 3 must be provided between the disc 1 and the piston 2 so as to actuate switch 4, and openings 9 and 10 must be cut so that terminals 6 and 7 can move together with piston 3. Further, the second electric switch 5 is spaced away from the first electric switch 4. Thus, the pressure switch is so complicated that assembling operation, replacement and inspection of the pressure switch are difficult.

SUMMARY OF THE INVENTION

Accordingly, an object of the present invention is to provide a pressure switch which is simple in construction and easy to assemble, install and inspect.

In order to achieve the above mentioned object, a pressure switch according to the present invention comprises a housing, a diaphragm fluid-tightly partitioning said housing and defining a pressure chamber into which fluid is introduced, said diaphragm transmitting a force in response to the pressure of the fluid, first switch means mounted in said housing, for assuming first or second switching conditions, second switch means mounted in said housing, for assuming a first or a second switching condition, first switch drive means for actuating said first switch means when the pressure of the fluid is between a predetermined first pressure value and a second pressure value, a first movable element supporting said first switch drive means, said first movable element being movable by said force applied through said diaphragm, second switch drive means for actuating said second switch means when the pressure of the fluid is between a predetermined third pressure value and a fourth pressure value, a second movable element supporting said second switch drive means, said second movable element being arranged between said diaphragm and said second switch means and also being movable by said force applied via said first movable element, a third movable element movable by said force applied through said second movable element, said third movable element actuating said second switch means when the pressure is less than a predetermined minimum pressure value, movement limiting means for limiting the movement of said second movable element, and urging means for urging said first to third movable elements in a direction against said force.

DETAILED DESCRIPTION OF THE PREFERRED EMBODIMENTS

Preferred embodiments of the present invention will now be described in detail with reference to the accompanying drawings.

Figure 1:
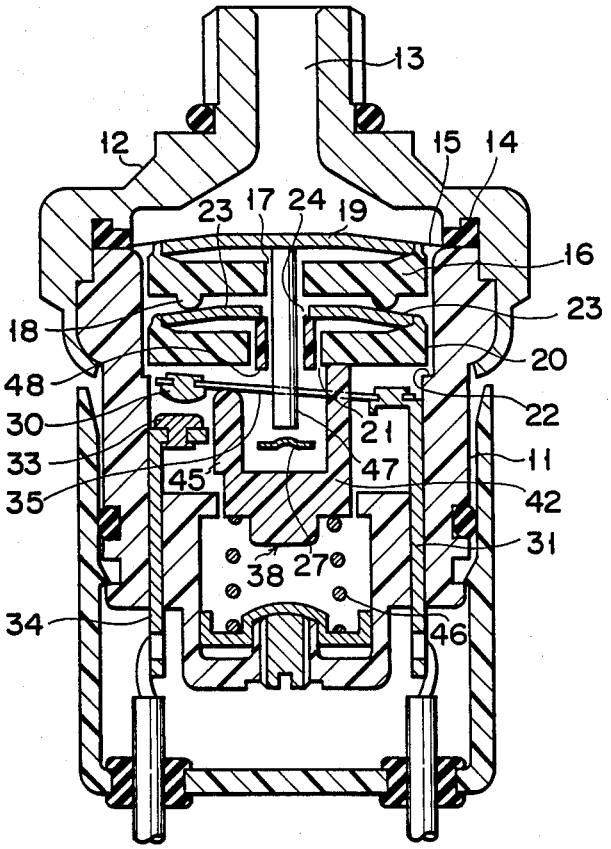
FIG. 1 is a schematic longitudinal sectional view of first embodiment of a pressure switch according to the present invention when the pressure of the refrigerant is abnormally low.

As shown in FIG. 1, a pressure switch comprises a cup-shape switch case 11, and a cover 12 fixed to the switch case 11 by caulking. Cover 12 has inlet opening 13 communicating with a refrigerant passage.

Diaphragm 15 is interposed at the peripheral edge thereof between switch case 11 and cover 12 through packing 14. A disc-like first movable element 16 is provided at an opposite side of inlet opening 13 through diaphragm 15 in switch case 11. The first movable element 16 has an opening 17 at the center thereof and an annular projection 18 on the lower surface thereof in FIG. 1. A first snap disc 19, supported at the peripheral edge thereof by movable element 16, is provided between the first movable element 16 and the diaphragm 15.

A disc-like second movable element 20 is provided under the first movable element 16 in FIG. 1, and movable elements 16 and 20 are vertically spaced from each other.

The second movable element 20 has an opening 21 at the center thereof, and can rest on stepped portion 22 formed on switch case 11 as will be mentioned later.

A second snap disc 23 is provided between the first movable element 16 and the second movable element 20, and is mounted at the peripheral edge thereof to the second movable element 20. The upper surface of the snap disc 23 can contact the annular projection 18 of the first movable element 16. The second snap disc 23 has a through hole 24 at the center thereof.

Each of the snap discs 19 and 23 is rapidly movable from a first state in which a first surface of the disc is concave to a second state, or reversed state, in which said surface of the disc is convex.

Figure 2:
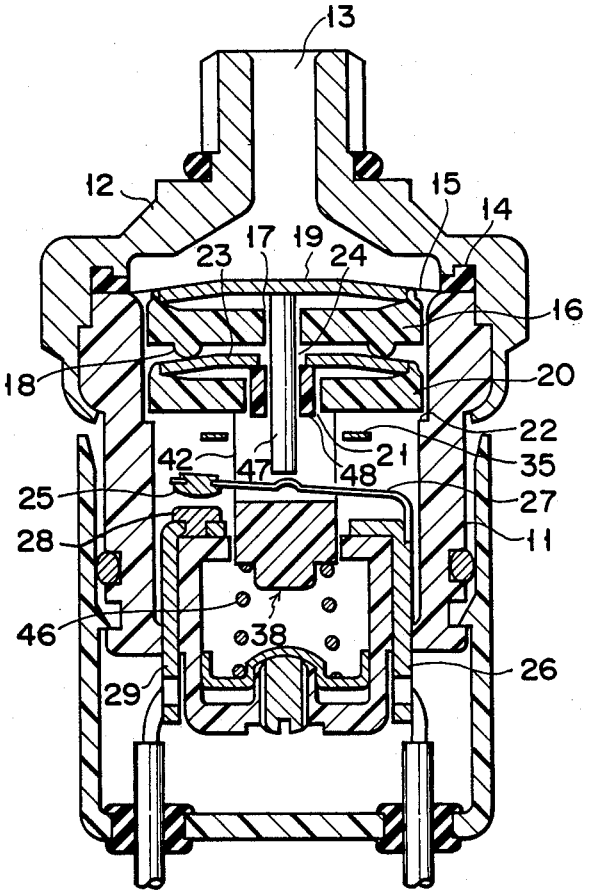
FIG. 2 is another longitudinal sectional view of the pressure switch, the view being taken on a plane normal to the sectional plane of FIG. 1.

As is shown in FIG. 2, terminals 26 and 29 are disposed at the lower end portion of switch case 11, extending vertically through switch case 11.

Terminals 26 and 29 are diametrically opposed to each other. Switch lever 27 is a leaf spring, and is connected at one end thereof to terminal 26. A first movable contact 25 is fixed to the other end of the switch lever 27. A first stationary contact 28 is opposed to the first movable contact 25 and is attached to terminal 29.

The first movable contact 25 is normally urged away from the first stationary contact 28 by the inherent spring bias of switch lever 27.

Both first movable and stationary contacts form a first switching means, which controls the fan motor of the condenser for the refrigerator, not shown.

In FIG. 1, terminals 31 and 34 are also disposed at the lower end portion of switch case 11 in the same manner.

Figure 6:
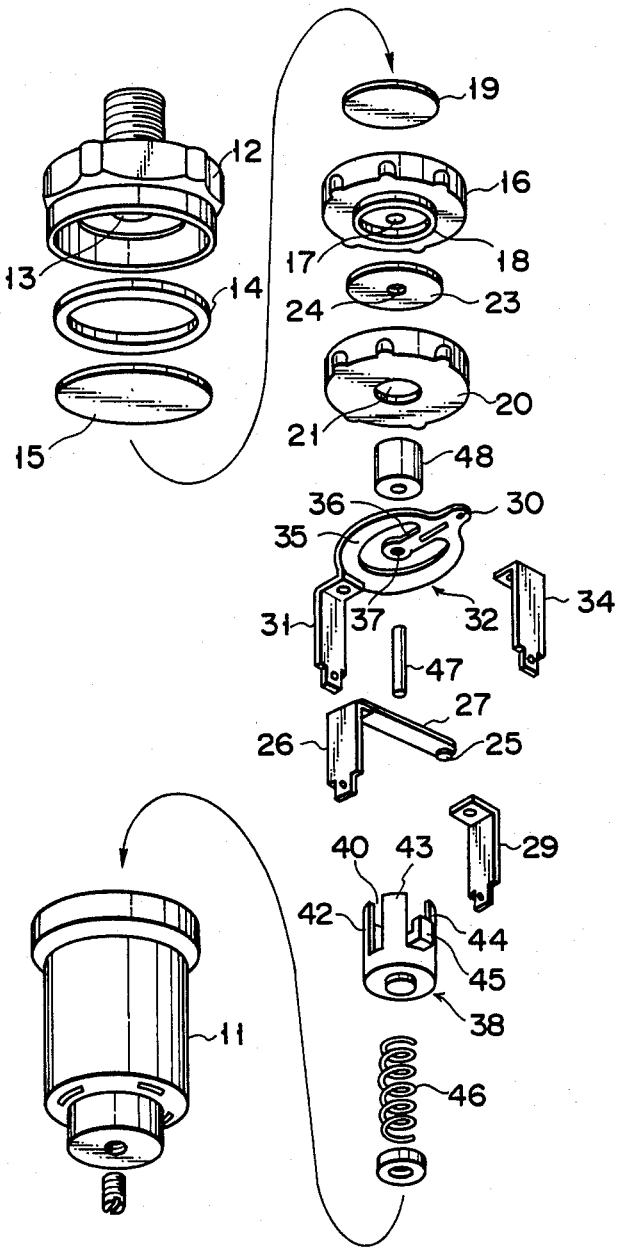
FIG. 6 is an exploded perspective view of the pressure switch of the present invention.

Terminals 31, 34, 26, 29 are equally spaced from each other, as shown in FIGS. 1 and 2, or disposed in quadrangular columnar array. As best shown in FIG. 6, switch lever assembly 32 is a ring-shape leaf spring, and is connected at one end thereof to terminal 31.

Figure 7:
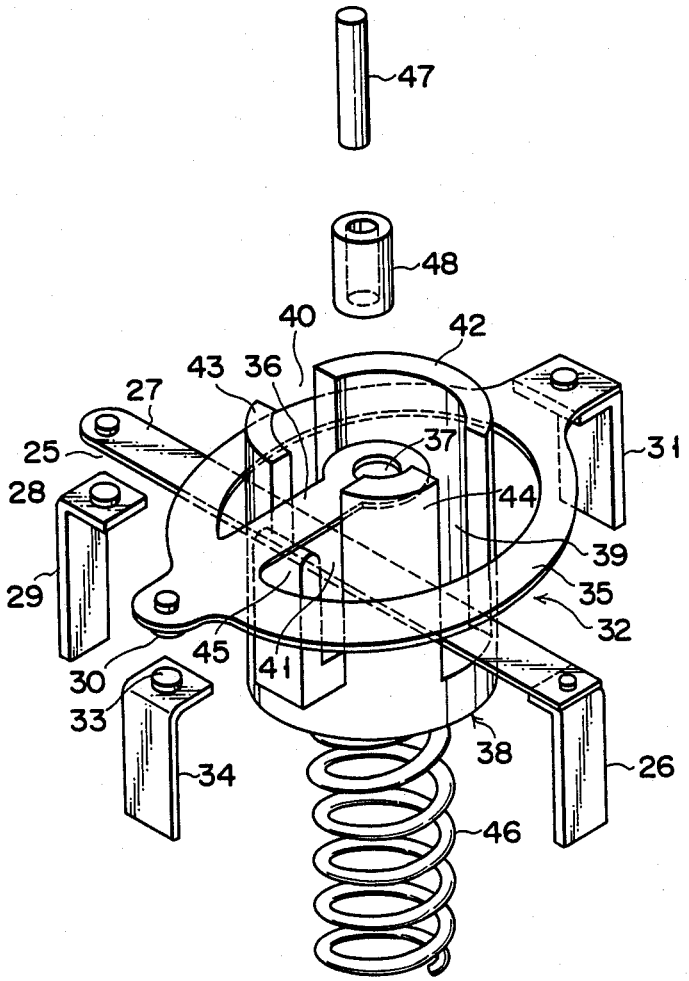
FIG. 7 is an exploded perspective view of the third movable element and its switch components.
Figure 8:
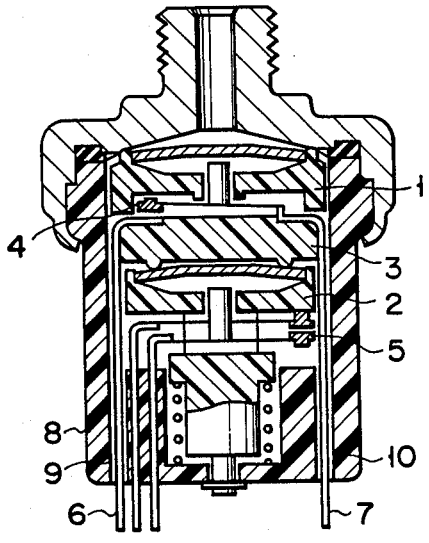
FIG. 8 (PRIOR ART)
FIG. 8 is a schematic longitudinal sectional view of a conventional pressure switch.

A second movable contact 30 is fixed to the other end is of switch lever assembly 32. As shown in FIG. 7, a second stationary contact 33 is opposed to the second movable contact 30 and is attached to terminal 34.

As is shown in FIG. 7, switch lever assembly 32 has a ring-like portion 35 and a projection 36. Projection 36 radially extends from the center of the ring-like portion 35 to the other end of the switch lever assembly 32. Projection 36 has an opening 37 at its free end.

The second movable contact 30 is urged by the inherent the spring bias of switch lever assembly 32 to contact the second stationary contact 33. Both the second movable contact 30 and the second stationary contact 33 form a second switching means, which controls the compressor of a refrigerator, not shown.

As is shown in FIG. 7, switch levers 27 and 32 are disposed in a vertically spaced relationship to one another so as to be free from interference.

As shown in FIG. 6, a third movable element 38 having a cylindrical cup-shape is arranged beneath the second movable element 20. As better shown in FIG. 7, this third movable element 38 has longitudinal slots 39, 40, 41. Slots 39 and 40 are diametrically opposed to each other in the cylindrical wall of the third movable element 38. Slot 41 is located circumferentially midway between slots 39 and 40. Switch lever 27 passes through slots 39 and 40. Projection 36 on the switch lever assembly 32 passes through slot 41, and the ring-like portion 35 of the switch lever assembly 32 concentrically surrounds the cylindrical wall of the third movable element 38. This third movable element 38 has an actuating projection 45 located near and extending radially outside slot 41.

As best shown in FIG. 6, a spring 46 is interposed between the bottom of the third movable element 38 and the inner bottom of the switch case 11. The ends of wall portions 42 and 43 of the third movable element 38 are always in contact with the lower surface of the second movable element 20. Thus, as best shown in FIG. 1, the movable element 20 is displaced separately from the stepped portion 22 of the switch case 11. Therefore, the spring 46 urges movable elements 16, 20, and 38 towards the diaphragm 15.

As shown in FIG. 6, the actuating projection 45 of the third movable element 38 is opposed to the projection 36 substantially at the intermediate portion of the projection 36 of the switch lever assembly 32.

A push rod 47 is provided between the first snap disc 19 and the switch lever 27 through the opening 17 in the first movable element 16, through the center hole 24 in the second snap disc 23, through the opening 21 of the second movable element 20, and through the opeing 37 in the projection 36. The upper end of the push rod 47 is connected to a central portion of a face of the snap disc 19.

A cylindrical member 48 surrounds push rod 47, and is provided between the second snap disc 23 and the free end of the projection 36 through the opening 21 in the second movable element 20. The upper end of the cyindrical member 48 is connected to a lower face of the snap disc 23.

Figure 3:
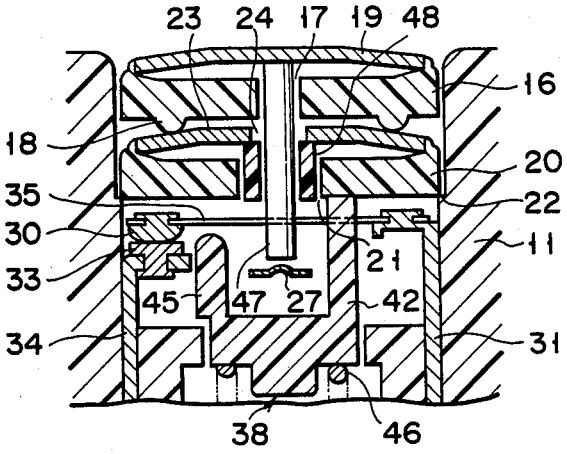
FIG. 3 is a partial view similar to FIG. 1, showing the pressure switch when the refrigerant pressure is normal.

The operation of the pressure switch constructed as mentioned above will now be described. When the pressure of the refrigerant introduced via inlet opening 13 reaches a predetermined minimum pressure, such as 2 kg/cm$^2$ G, a force in response to the pressure is transmitted via diaphragm 15 to the first snap disc 19. This force displaces downward the third movable element 38 against a restoring force of the spring 46 through the first movable element 16, second snap disc 23, and the second movable element 20. As shown in FIG. 3, the second movable element 20 rests on the stepped portion 22 of the switch case 11 at this time.

By displacing the third movable element 38 as mentioned above, the actuating projection 45 is set apart from the projection 36 of the switch lever assembly 32 and the second movable contact 30 contacts the second stationary contact 33 because of the inherent spring bias of the switch lever assembly 32. Thus, the compressor starts operating.

Since the first snap disc 19 is not bent convexly towards the switch lever 27, at this time, the push rod 47 does not depress the switch lever 27. Thus, as shown in FIG. 2, the first movable contact 25 separates from the first stationary contact 28. Accordingly, the fan motor of the condenser does not rotate (FIG. 3).

Figure 4:
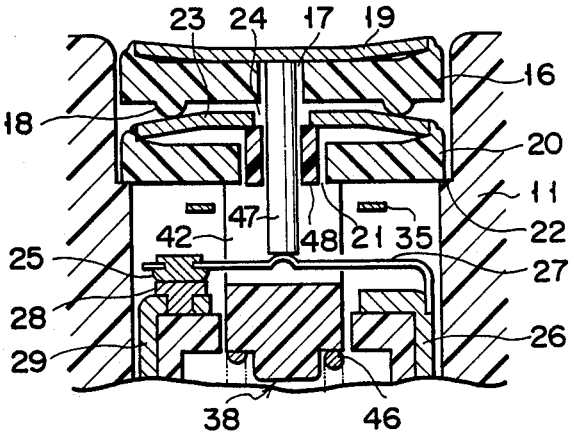
FIG. 4 is a partial view similar to FIG. 2, showing the pressure switch when the pressure of the refrigerant in the condenser reaches a predetermined first pressure value.

However, since the fan motor of the condenser does not rotate as mentioned above, the temperature and the pressure of the refrigerant in the condenser will gradually rise. When the pressure of the refrigerant reaches a predetermined first pressure value, such as 15 kg/cm$^2$ G, the first snap disc 19 is rapidly reversed through diaphragm 15 so as to become convexly towards the switch lever 27. AS shown in FIG. 4, the push rod 47 depresses the switch lever 27, contacting the first movable contact 25 with first stationary contact 28 against the restoring force of the switch lever 27. Thus, the fan motor of the condenser starts operating.

Since the second snap disc 23 is not yet reversed by the force in response to this pressure at this time, the cylindrical member 48 does not press against the switch lever assembly 32. Thus, the second movable contact 30 is still in contac with the second stationary contact 33, and the compressor continues operating (FIG. 4).

While the fan motor is rotated as mentioned above, the temperature and the pressure of the refrigerant in the condenser will decrease. When the pressure of the refrigerant reaches a predetermined second pressure, for example, 11 kg/cm$^2$ G, the first snap disc 19 is returned to its first state and the push rod 47 is displaced upward. Thus, the first movable contact 25 is again set apart from the first stationary contact 28 to stop the fan motor.

With the compressor operating continuously, the turning on and off of the fan motor of the condenser are repeated as mentioned above. This is the normal operation of the refrigerator.

However, when the pressure of the refrigerant abnormally rises to a predetermined third value, for example, 27 kg/cm$^2$ due to clogging of the condenser, the first snap ring 19 is reversed, and the annular projection 18 of the first movable element 16 pushes against the second snap disc 23, thus reversing the second snap disc 23. Cylindrical member 48, which is connected to the face of the snap disc 23, is displaced downward so that the free end of the projection 36 of the switch lever assembly 32 is depressed.

Figure 5:
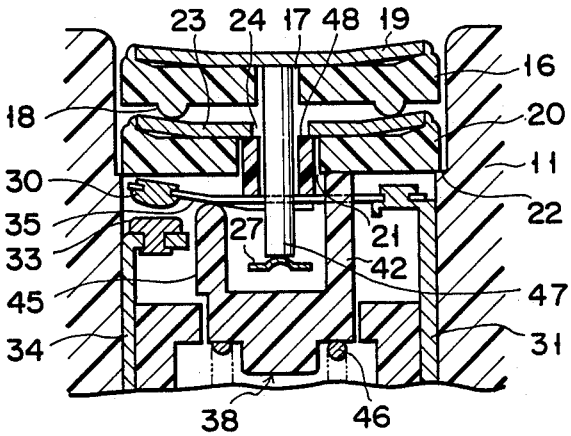
FIG. 5 is a sectional view similar to FIG. 3, showing the pressure switch when there is an abnormally high refrigerant pressure.

Projection 36 is pivoted about the actuating projection 45 of the third movable element 38, and the second movable contact 30 is set apart from the second stationary contact 33, thus stopping the compressor. Since the first snap disc 19 is in its reversed state at this time, the fan motor of the condensor continues operating (FIG. 5).

Because the compressor is stopped, the pressure of the refrigerant will drop. When the pressure of the refrigerant returns to a normal value, or a predetermined fourth pressure value, the second snap disc 23 is returned to its original first state, and the cylindrical member 48 is displaced upward. Thus, the second movable contact 30 is again in contact with the second stationary contact 33, thus restarting the compressor.

In case the pressure of the refrigerant abnormally drops due to the leakage of the refrigerant, the second snap disc 23, the first movable element 16, the first snap disc 19, the second movable element 20, and the third movable element 38 are displaced upward by the restoring force of the spring 46. Actuating projection 45 of the third movable element 38 pushes upward the switch lever assembly 32 through the end projection 35 to set apart the second movable contact 30 from the second stationary contact 33, thus stopping the compressor.

Since the push rod 47 which is connected to the first snap disc 19 does not depress the switch lever 27 at this time, the first movable contact 35 is set apart from the first stationary contact 28 by the inherent spring bias of the switch lever 27, thus stopping the fan motor (FIGS. 1 and 2).

When the pressure of the refrigerant returns to its normal value, the compressor restarts operating as mentioned above.

The pressure switch according to the present invention provides the three mode operation as described above. In the pressure switch of the present invention, there is no switch between the first movable element 16 and the second movable element 20, all contacts are disposed under the second movable element 20 and the terminals are fixed to the switch case 11. Therefore, the pressure switch of the present invention is no simple in construction that assembling, replacing and checking it for the operation of the switch can be done with ease.

What is claimed is:

1. A three-function pressure switch comprising:

means for introducing fluid pressure;

means for responding to the flud pressure;

a casing;

a first switch means placed in said casing, said first switch means including a pair of first terminals facing each other, provided for in said casing, a first stationary contact for one of said first terminals, a first movable contact for touching said first stationary contact, and a lever member connected to another one of said first terminals at one end and provided with said first movable contact at another end such that said first movable contact is biased away from said first stationary contact by said lever member;

a second switch means placed adjacent to said first switch means in said casing, said second switch means including a pair of second terminals facing each other, provided for in said casing, a second stationary contact for one of said second terminals, a second movable contact corresponding to said second stationary contact, and a lever assembly which can work on said second movable contact to touch said second stationary contact, said second movable contact being biased away from said second stationary contact by said lever assembly, said lever assembly including a main lever and a sublever, said sublever having said second movable contact at one end and having a free end at another end, said main lever having one end connected to another end of said second terminals and having another end connected to a portion between said two ends of said sublever;

a first movable member provided in said casing between said first movable contact and said second switch means, and being capable of moving through the work of said means for responding to the fluid pressure;

a second movable member provided in said casing between said first movable member and said second switch means, and being capable of moving through the work of said means for responding to the fluid pressure with the help of said first movable member;

a first switch driving means for actuating said first switch means when the pressure of the fluid is between a first predetermined pressure value and a second predetermined pressure value;

a second switch driving means for pushing another side of the main lever of said second switch means due to the motion of said second movable member, thereby causing said second movable contact to touch said second stationary contact when the pressure exceeds a predetermined minimum pressure value;

a first switch operating means, supported on said first movable member, for operating the first switch means by acting on the lever member of said first switch means driven by said means for responding to the fluid pressure, wherein said first switch operating means causes said first movable contact to touch said first stationary contact when the pressure increases to the first predetermined pressure value, while causing said first movable contact to leave said first stationary contact when the pressure decreases to the second predetermined pressure value, where said second predetermined pressure value is lower than said first predetermined pressure value; and a second switch operating means, supported on said second movable member and operated by said means for responding to the fluid pressure with the help of said first movable member, for operating the second switch means by rotating the sublever with respect to the main lever acting on a free end of the sublever of said second switch means, wherein said second switch operating means causes said second movable contact to touch said second stationary contact when the pressure increases to a third predetermined pressure value, causing said second movable contact to leave said second stationary contact when the pressure decreases to a fourth predetermined pressure value, where said fourth predetermined pressure value is lower than said third predetermined pressure value.

2. The pressure switch according to claim 1, wherein:

said first terminals and said second terminals are arranged longitudinally to said casing and are disposed in a quadrangular columnar array.

3. The pressure switch according to claims 1, wherein:

said first switch operating means includes:

a first snap disc means having a periphery contacting said first movable element, said first snap disc means being capable of rapidly shifting from a first state in which a surface thereof is concave, to a second state in which the surface thereof is convex, and assuming said first state at said first predetermined pressure value and assuming said second state at said second predetermined pressure value; and a first actuating member connected to the surface of said first snap disc means, said first actuating member actuating said first switch operating means by shifting the state of said first snap disc means; and said second switch operating means includes:

a second snap disc means having a periphery contacting said second movable element, said second snap disc means being capable of rapidly shifting from a first state in which a surface thereof is concave, to a second state in which the surface thereof is convex, and assuming said first state at said predetermined third pressure value and assuming said second state at said fourth predetermined pressure value; and a second actuating member connected to the surface of said second snap disc means, said second actuating member actuating said second switch operating means by shifting the state of said second snap disc means.

4. The pressure switch according to claim 3, wherein:

said second switch means is placed nearer to said second movable member than to said first switch means;

said first snap disc means includes a first snap disc and said first actuating means includes a push rod connected at one end to a center portion of said first snap disc, the other end of said push rod facing said lever member of the first switch means; and said second snap disc means includes a second snap disc having a central opening, being arranged along said diaphragm, and said second actuating means includes a cylindrical member having a center hole and being connected at one end to a center portion of said second snap disc, the other end of said cylindrical member facing said lever assembly of the second switch means, and said push rod penetrating through said central opening of the second snap disc and through said center hole of said cylindrical member.

5. The pressure switch according to claim 4, wherein:

said first movable element is a first piston slidably guided in said casing and having a center opening through which said push rod extends, also having a peripheral edge portion for supporting said first snap disc on one surface thereof, and furthermore having an annular projection for pressing said second snap disc on the other side surface thereof; and said second movable element is a second piston slidably guided in said casing and having a center opening through which said cylindrical member extends, and also having a peripheral edge portion for supporting said second snap disc on one side surface thereof and abutting on said third movable element on the other side surface thereof.

6. The pressure switch according to claim 1, wherein:

said second switch operating means includes a third movable member being moved by said second movable member and operating on another end of said main lever, a means for urging said third movable member along with said first and second movable members against pressure, and means for adjusting an urging force generated by said urging means to cause said second movable contact and said second stationary contact to touch when the pressure extends said predetermined minimum pressure value.

7. The pressure switch according to claim 1 further comprising:

means for positioning said first and second switch operating means by limiting the motion of said second movable member.

8. The pressure switch according to claim 5, wherein:

said third movable element includes a stud having an abutting portion extending in a longitudinal direction in a peripheral area of said cylindrical member which abuts against said second piston, and also having a functional portion extending in the longitudinal direction in the peripheral area of said cylindrical member, engagable with another portion of said main lever, said functional portion of the stud serving as a fulcrum for said sublever which is engaged with another portion of sid main lever when the sublever is rotated with respect to the main lever by said second switch operating means.

9. The pressure switch according to claim 8, wherein:

said lever member of said first switch means includes a leaf spring elongated to cross a center portion of said casing;

said lever assembly of said second switch means includes an integral leaf spring having a main lever containing a ring portion surrounding said stud; and said sublever, which has a free end extending to the center portion of said casing, has a hole for the push rod of said first movable element to go through.

* * * * *

UNITED STATES PATENT AND TRADEMARK OFFICE

CERTIFICATE OF CORRECTION

PATENT NO. : 4,820,890

DATED : April 11, 1989

INVENTOR(S) : Yuuichi Tamura et al.

It is certified that error appears in the above-identified patent and that said Letters Patent is hereby corrected as shown below:

Cover page, col. 1, last line, change "Scaffetta" to --Scafetta--.

Cover page, col. 2, line 17, change "First" to --The first--.

Specification, col. 1, line 22, change "of" to --or--.

Col. 2, line 6, before "first" insert --a--.

Col. 2, line 34, change "cup-shape" to --cup-shaped--.

Col. 3, line 18, change "ring-shape" to --ring-shaped--.

Col. 3, line 21, delete "is".

Col. 3, line 30, delete "the" and insert --the-- after "of".

Col. 4, line 3, change "opeing" to --opening--.

Col. 4, line 44, after "become" insert --bent--.

Col. 4, line 45, change "AS" to --As--.

Col. 4, line 54, change "contac" to --contact--.

Col. 4, line 66, change "are" to --is--.

Col. 5, line 3, after "$kg/cm^2$" insert --G--.

Col. 5, line 52, change "no" to --so--.

UNITED STATES PATENT AND TRADEMARK OFFICE

CERTIFICATE OF CORRECTION

PATENT NO. : 4,820,890

DATED : April 11, 1989

INVENTOR(S) : Yuuichi Tamura et al.

It is certified that error appears in the above-identified patent and that said Letters Patent is hereby corrected as shown below:

Claim 1, col. 5, line 58, change "flud" to --fluid--.

Claim 3, col. 7, line 9, change "claims" to --claim--.

Claim 8, col. 8, line 45, change "sid" to --said--.

Signed and Sealed this

Twenty-sixth Day of December, 1989

*Attest:*

JEFFREY M. SAMUELS

*Attesting Officer* *Acting Commissioner of Patents and Trademarks*